United States Patent [19]

Fowlston

[11] Patent Number: 4,670,938

[45] Date of Patent: Jun. 9, 1987

[54] ONE PIECE FLEXIBLE HINGE HAVING ENGAGING RIDGES AND A RIB

[76] Inventor: Kenneth B. Fowlston, R.R. #3, Tottenham, Ontario, Canada, L0G 1W0

[21] Appl. No.: 799,545

[22] Filed: Nov. 15, 1985

Related U.S. Application Data

[63] Continuation of Ser. No. 609,715, May 14, 1984, abandoned.

[51] Int. Cl.[4] ..... E05D 1/02

[52] U.S. Cl. ..... 16/225; 16/382; 16/385; 16/DIG. 13; 220/339

[58] Field of Search ..... 16/225, 382, 385, DIG. 13, 16/DIG. 40; 220/339; 282/29, 42, 45

[56] References Cited

U.S. PATENT DOCUMENTS

| | | | |
|---|---|---|---|
| 236,414 | 1/1881 | Briggs | 16/225 X |
| 3,445,052 | 5/1969 | Lewallen | 16/385 X |
| 3,592,354 | 7/1971 | Nielsen | 16/225 X |
| 4,131,971 | 1/1979 | Saarloos | 16/225 |
| 4,296,524 | 10/1981 | Horholt et al. | 16/225 |

FOREIGN PATENT DOCUMENTS

| | | | |
|---|---|---|---|
| 273333 | 9/1964 | Australia | 16/385 |
| 2346863 | 3/1975 | Fed. Rep. of Germany | 16/DIG. 13 |
| 1517445 | 2/1968 | France | 16/DIG. 13 |

*Primary Examiner*—Fred Silverberg

[57] ABSTRACT

A hinge for joining a pair of panels, the hinge comprising a first member U-shaped in cross-section with a pair of side walls and a base, at least one of the side walls having a rib parallel to the base and projecting towards the other wall, the rib being receivable in a groove in one of the panels, a second member attachable to the other panel and a flexible web interconnecting the base of the first member and the second member. The second member may be a mirror image of the first member.

5 Claims, 4 Drawing Figures

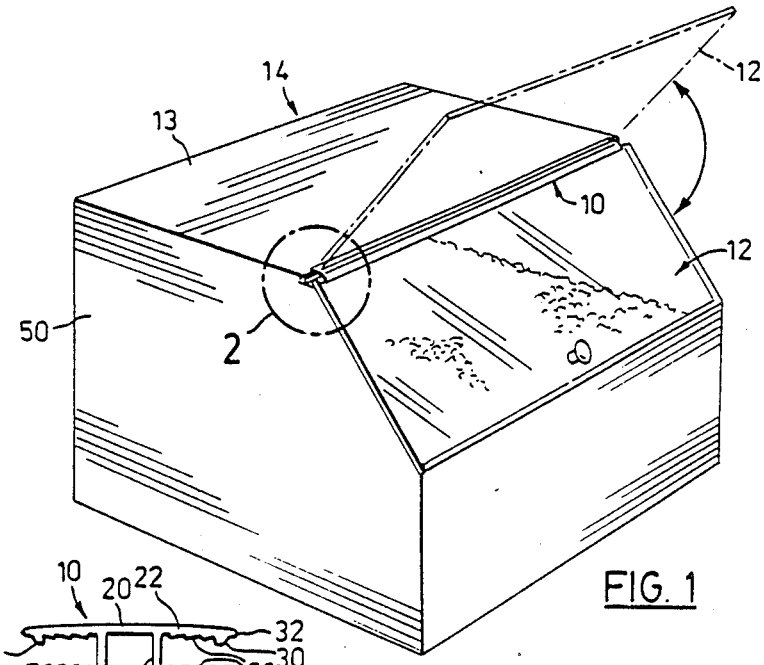
FIG. 1
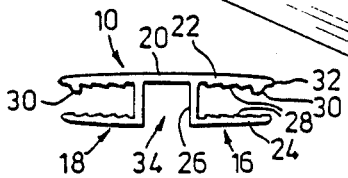
FIG. 3
FIG. 4
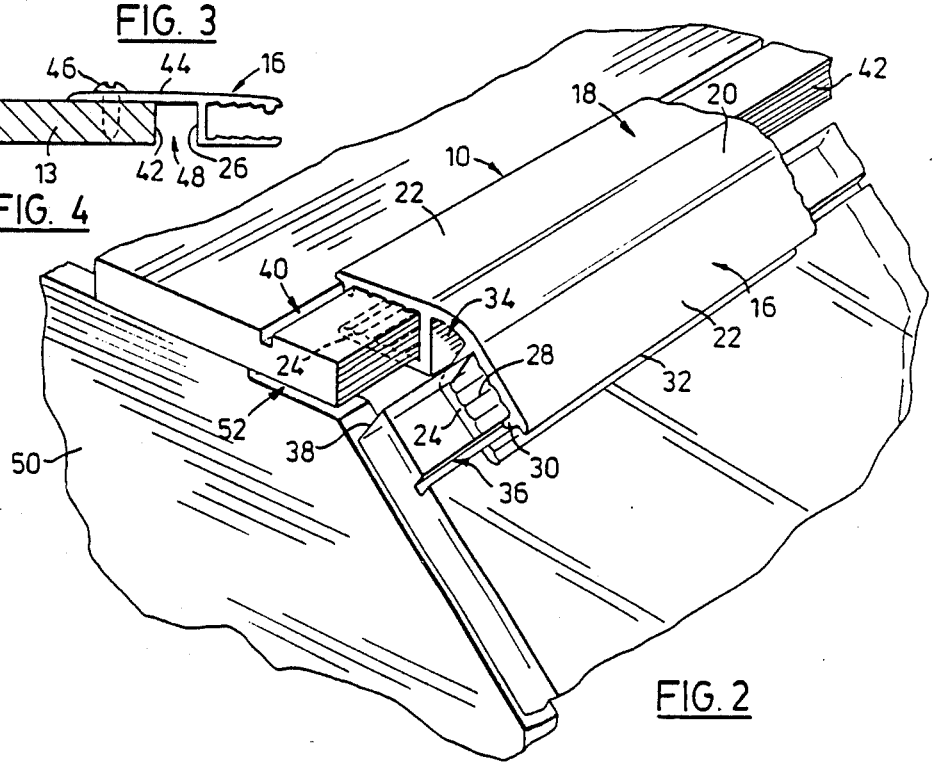
FIG. 2

ONE PIECE FLEXIBLE HINGE HAVING ENGAGING RIDGES AND A RIB

This application is a continuation of application Ser. No. 609,715, filed May 14, 1984 now abandoned.

FIELD OF THE INVENTION

This invention relates to a hinge for use in joining a pair of panels.

BACKGROUND OF THE INVENTION

Banks of lidded containers of transparent acrylic plastic are now used in stores to display bulk goods and to allow self-service. Such containers are especially convenient in health food stores stocking an assortment of grains and nuts. The hinges on the lids of these containers are subject to heavy use and tend to wear out quickly, requiring replacement of the whole container which is expensive in material, or of the hinge itself which is expensive in labour.

Snap-on plastic hinges are known which have a pair of jaws joined by a flexible strip and which are employed by clipping the jaws over strips protruding from each of two panels to join them. Such a hinge is shown in U.S. Pat. No. 4,131,971 issued Jan. 2, 1979 to Saarloos. A similar jaw with a serrated gripping surface is shown in French Pat. No. 2,495,682 to Petitcollot in which the jaw clamps directly onto the panel with no intervening strip. However, with smooth acrylic plastic such hinges are not effective for heavy use.

It is an object of the present invention to provide a hinge, for mounting a panel, which is both effective and easy to replace.

SUMMARY OF THE INVENTION

Essentially the invention consists of a lid for a container, the lid comprising a first panel and a hinge connecting the first panel to a second panel of the container substantially the entire length thereof, the hinge comprising a first member U-shaped in cross-section with a pair of side walls and a base, at least one of the side walls having a rib parallel to the base and projecting towards the other wall, a groove in the first panel parallel to and adjacent one edge thereof of said one edge lying within the first member between the walls thereof with the rib of the first member engaging the groove, the hinge also comprising a second member attached to the second panel, and a flexible web interconnecting the base of the first member and the second member.

BRIEF DESCRIPTION OF THE DRAWINGS

An example embodiment of the invention is shown in the accompanying drawings in which:

FIG. 1 is a perspective view of a container having a hinged lid;

FIG. 2 is an enlargement of the hinge indicated by broken circle 2 in FIG. 1;

FIG. 3 is an end view of the hinge of FIGS. 1 and 2; and

FIG. 4 is an end view of an alternate embodiment of the hinge of FIGS. 1 to 3.

DESCRIPTION OF PREFERRED EMBODIMENT

The example embodiment shown in FIGS. 1 to 3 of the drawings consists of a hinge 10 mounting a first panel in the form of a lid 12 on second panel in the form of a top wall 13 of a container 14.

Hinge 10 comprises a first member 16, a second member 18 which is a mirror image of first member 16 and spaced from the first member, and an interconnecting web 20. First member 16 is U-shaped with a pair of side walls 22 and 24 and a base 26. Each side wall 22 and 24 is serrated in cross-section with ridges 28 parallel to base 26, and the side walls are slightly convergent towards their free edges. Side wall 22 carries a rib 30 parallel to base 26 and adjacent free edge 32 of the side wall. Rib 30 projects inwardly towards opposite side wall 24.

Second member 18 of hinge 10 is a mirror image of first member 16. The two members 16 and 18 are interconnected by web 20 along one edge of base 26 with the web lying in the plane of walls 22 of the two members and bridging a gap 34.

Lid 12 carries a groove 36 parallel to a free edge 38 of the lid and when edge 38 of the lid is located in first member 16 between side walls 22 and 24 to abut base 26, rib 30 engages groove 36. A similar groove 40 in top wall 13 of container 14 is engaged by rib 20 of second member 16 when the free edge 42 of the top wall abuts base 26 of the second member.

Hinge 10, extending substantially the entire length of lid 12 and top wall 13 is preferably made of plastic material which imparts a spring to side walls 22, 24, allowing the side walls to be spread apart sufficiently to enable panels 12 and 13 to be inserted and then seating ribs 30 in grooves 36 and 40. A suitable material for the purpose is PVC (polyvinylchloride) with web 20 being a more flexible form of the material. Polypropylene is another suitable material. The plastic material may be extruded to form hinge 10, web 14 being integral with members 16 and 18, or injection molded.

Lateral walls 50 of container 14 may include slots 52 in conjunction with top wall 13 adjacent free edge 42 to allow side wall 24 of member 18 of hinge 10 to slide along top wall 13 for engagement of the hinge.

In the alternate embodiment of the invention shown in FIG. 4 of the drawings second member 18 is replaced by a flange 44 which is an extension of web 20 and is secured to top wall 13 of container 14 by screws 46 or other suitable means, leaving a gap 48 between free edge 42 of top wall 13 and base 26 of first member 16.

I claim:

1. In a container, a lid comprising a first panel and a hinge connecting the first panel to a second panel of the container substantially the entire length thereof, the hinge comprising a first member and a second member each U-shaped in cross-section with a pair of side walls and a base, one of the side walls of each member having a rib parallel to the base and projecting towards the other wall, a groove in the outer face of the first panel parallel to and adjacent one edge thereof with the rib of the first member engaging the groove of the first panel, a groove in the outer face of the second panel parallel to and adjacent one edge thereof with the rib of the second member engaging the groove of the second panel, and a flexible web interconnecting the base of the first member and the second member and integral therewith, the web and said one of the side walls of each member having the rib being coplanar with each other when the hinge is in a relaxed position, the other of the side walls of each said member being coplanar with each other when the hinge is in said relaxed position, said base of each of said members being substantially parallel to each other when the hinge is in said relaxed position, in which the first panel comprises the top of the container which is fixed to a pair of opposed side walls at each end thereof, and a slot in each side wall bounded by the top whereby the hinge is slidable laterally onto the first panel.

2. The hinge as claimed in claim 1 in which the material forming the hinge is polyvinylchloride.

3. The hinge as claimed in claim 1 in which the material forming the hinge is polypropylene.

4. The hinge as claimed in claim 1 in which each of said side walls of said first and second members is serrated in cross-section on the inner side thereof.

5. The hinge as claimed in claim 1 in which the side walls of said first and second members are slightly convergent towards their free edges.

* * * * *